US008376184B2

(12) United States Patent
Buchstab et al.

(10) Patent No.: US 8,376,184 B2
(45) Date of Patent: Feb. 19, 2013

(54) ICE DISPENSER WITH AUTOMATED FLAP OPENING

(75) Inventors: Martin Buchstab, Bopfingen (DE); Jürgen Diebold, Hermaringen (DE); Irene Dumkow, Sontheim (DE); Klaus Flinner, Zöschingen (DE); Markus Hanichl, Heidenheim (DE); Bernd Heger, Haunsheim (DE); Peter Nalbach, Iserlohn (DE); Günter Raubold, Neu-Ulm (DE); Gerald Schmidt, Gerstetten (DE); Martin Schweyer, Bissingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 373 days.

(21) Appl. No.: 12/679,708

(22) PCT Filed: Sep. 12, 2008

(86) PCT No.: PCT/EP2008/062190

§ 371 (c)(1),
(2), (4) Date: Mar. 24, 2010

(87) PCT Pub. No.: WO2009/049979

PCT Pub. Date: Apr. 23, 2009

(65) Prior Publication Data

US 2010/0200621 A1 Aug. 12, 2010

(30) Foreign Application Priority Data

Oct. 10, 2007 (DE) ..... 10 2007 048 574

(51) Int. Cl.
*B67D 3/00* (2006.01)
*G05D 7/00* (2006.01)

(52) U.S. Cl. ..... 222/52; 222/644; 222/504; 222/146.1; 222/556; 62/150

(58) Field of Classification Search ..... 222/52, 222/63, 638, 639, 644, 146.1, 146.6, 504, 222/556; 62/135, 137, 138, 150, 233
See application file for complete search history.

(56) References Cited

U.S. PATENT DOCUMENTS 3,403,525 A * 10/1968 Beckwith et al. ..... 62/82
3,463,362 A * 8/1969 Garber ..... 222/254
(Continued)

FOREIGN PATENT DOCUMENTS

EP 1770342 A2 4/2007

*Primary Examiner* — Kevin P Shaver
*Assistant Examiner* — Patrick M Buechner
(74) *Attorney, Agent, or Firm* — James E. Howard; Andre Pallapies

(57) ABSTRACT

A device for removing condensation from an ice duct of an ice dispenser for a refrigerator. The device may include a flap, which is arranged to seal an output opening of the ice dispenser and a controller for the flap, which is designed to move the flap between a closed position, in which the inner side of the flap contacts the edge of the outlet opening and a dispensing position in which the flap is withdrawn from the edge of the outlet opening to permit the dispensing of ice cubes. Further, the controller is designed to open the flap after expiry of a first time period, during which the flap is not moved by the action of a user or by the controller and to close the flap after expiry of a second time period.

18 Claims, 2 Drawing Sheets

U.S. PATENT DOCUMENTS 3,517,860 A * 6/1970 Whalen ..... 222/202
3,518,841 A * 7/1970 West, Jr. ..... 62/153
4,090,641 A * 5/1978 Lindenschmidt ..... 222/504
4,846,381 A * 7/1989 Kito et al. ..... 222/638
4,904,910 A * 2/1990 Hsu ..... 318/445
5,474,213 A 12/1995 Unger
5,886,430 A * 3/1999 Ralson et al. ..... 62/344
6,533,003 B1 * 3/2003 Jacobus et al. ..... 222/146.6
7,453,351 B2 * 11/2008 Fitzgibbon et al. ..... 340/527
2004/0237568 A1 12/2004 Devos
2006/0144075 A1 * 7/2006 Bowen et al. ..... 222/146.6
2007/0119204 A1 * 5/2007 Kwon ..... 62/340
2007/0256442 A1 * 11/2007 Lyvers et al. ..... 62/344
2009/0045213 A1 * 2/2009 Dirnberger et al. ..... 221/154

* cited by examiner

ICE DISPENSER WITH AUTOMATED FLAP OPENING

BACKGROUND OF THE INVENTION

The present invention relates to an ice dispenser for a refrigerating device and in particular to the draining of condensation water at an ice duct of such an ice dispenser.

In refrigeration appliances with built-in ice makers, an ice dispenser generally contains a duct that runs through a housing wall, in particular the door, of the refrigeration appliance, the outer end of said duct being able to be closed by a flap in order, during non-utilization, to prevent warm air passing through the duct into the interior of the refrigeration appliance. The flap is thermally insulated and has a seal running all round the flap so that with the flap closed the ice dispenser can be protected to the best possible extent against warm air entering from outside. Normally the flap is only opened when ice is to be dispensed from the ice dispenser.

When ice, in particular crushed ice, is being dispensed, ice residues which thaw and collect as water at the lower end of the duct in front of the closed flap can remain behind. Even if ice cubes in the ice maker are occasionally agitated in order to prevent the ice cubes in the ice maker solidly freezing together, ice residues can reach the duct and thaw. If nothing else, moisture can collect in the duct as a result of condensation, in particular from warm outside air that has entered the duct during the dispensing of ice. The flap prevents the water from flowing away, with the result that it accumulates behind the closed flap. The problem therefore arises that when the flap is next opened for the dispensing of ice, a small gush of water emerges before the ice is dispensed. A user of the appliance, however, finds this to be a nuisance if the volume of the emerging condensation water amounts to more than a few drops.

When the door of the appliance is closed there is a brief increase in the air pressure inside the appliance. If this causes the flap to be forced open, any condensation water present will be discharged from the duct. This can also result in spray and generation of noise, which the user likewise perceives as a nuisance.

BRIEF SUMMARY OF THE INVENTION

The object of the present invention is therefore to create a device by means of which uncontrolled egress of condensation water from the flap of the ice dispenser is reliably prevented in a simple manner, without any adverse effect on the leak tightness of the flap as a whole.

This object is achieved in that in the case of an ice dispenser for a refrigeration appliance having an ice duct that is closable by a flap and having a control unit for the flap, said control unit being configured to move the flap between a rest position in which it closes the ice duct and a dispensing position in which it opens the flap for the purpose of dispensing ice cubes, the control unit furthermore being configured to open the flap on the expiration of a first time period during which the flap has not been moved and to open the flap for a second time period. Because the control unit automatically opens the flap on the expiration of a specific time period, the condensation water that has accumulated in the ice duct in the time since the last opening of the flap can flow away to the outside, thereby reliably preventing larger amounts of condensation water from accumulating in front of the outlet opening over time. Since the flap opens automatically there is a very low probability that the condensation water will run out precisely at the instant that a user wishes to remove ice. Because the control unit recloses the flap after the condensation water has been drained off, the inflow of moist, warm outside air into the refrigeration appliance that is unavoidably associated with the opening of the flap is small.

Instead of directly monitoring the position of the flap it is more advantageous if the control unit detects when the ice dispenser is used and restarts the first time period with each use. Therefore the functions of the inventive control unit can additionally be beneficially carried out by a conventional control circuit for dispensing the ice, which in any case has to detect each use of the ice dispenser and react to it. If ice has been removed at the ice dispenser and the flap has been opened for that purpose, it can be assumed that subsequently there is no more condensation water present in the ice duct. It is therefore sufficient if, after ice is removed, the control unit waits for the full first time period to elapse before it reopens the flap in order to drain off the condensation water the next time.

It is equally advantageous if the control unit directly monitors the closing of the door and not any movement of the flap possibly caused thereby. Every refrigeration appliance includes a switch for monitoring the door position and this switch can be utilized for the control unit with minimal outlay. Since it can be assumed that the ice duct is free of condensation water also after the door has been closed, it is sufficient in this case too if the control unit waits for the full first time period to elapse before it reopens the flap to drain off the condensation water the next time.

It is particularly advantageous for the energy efficiency of the refrigeration appliance if the control unit is configured to move the flap to a position which lies between the rest position and the dispensing position following expiration of the first time period. Whereas the flap must remain wide open for the dispensing of the ice, opening the flap just a crack is adequate for draining off the condensation water. A mere partial opening of the flap can prevent warm air from flowing unnecessarily through the outlet opening into the interior of the appliance.

An electromagnet to which at least two permanent energizing currents are applied—one for the partially-open and one for the fully-open position—is suitable for setting a partially-open flap position.

With regard to the mode of operation of the device there are advantages if the first time period is a multiple of the second time period. The first time period, during which the flap is held closed, defines the longest possible intervals between the automatic opening and closing of the flap, so that the flap is not opened unnecessarily frequently. The second time period, during which the flap is open, can be kept very short since the condensation water can run away instantly through the downward-directed opening of the ice duct.

The device can work in an optimum fashion if the first time period comprises a time interval of at least one hour. This therefore ensures that the accumulated quantity of condensation water always remains sufficiently small to be unnoticed when it flows away when ice is being removed.

A second time period of between 5 and 10 seconds is sufficient to allow the condensation water to flow away essentially completely.

Furthermore, it is advantageous for the reliability of the device if the flap is heated. This can prevent the flap freezing to the duct in the closed position and unable to be opened at regular intervals.

BRIEF DESCRIPTION OF THE DRAWINGS

Further features and advantages of the invention are revealed in the following description of exemplifying embodiments with reference to the attached figures, in which.

DETAILED DESCRIPTION OF EXEMPLARY EMBODIMENTS OF THE PRESENT INVENTION

Figure 1:
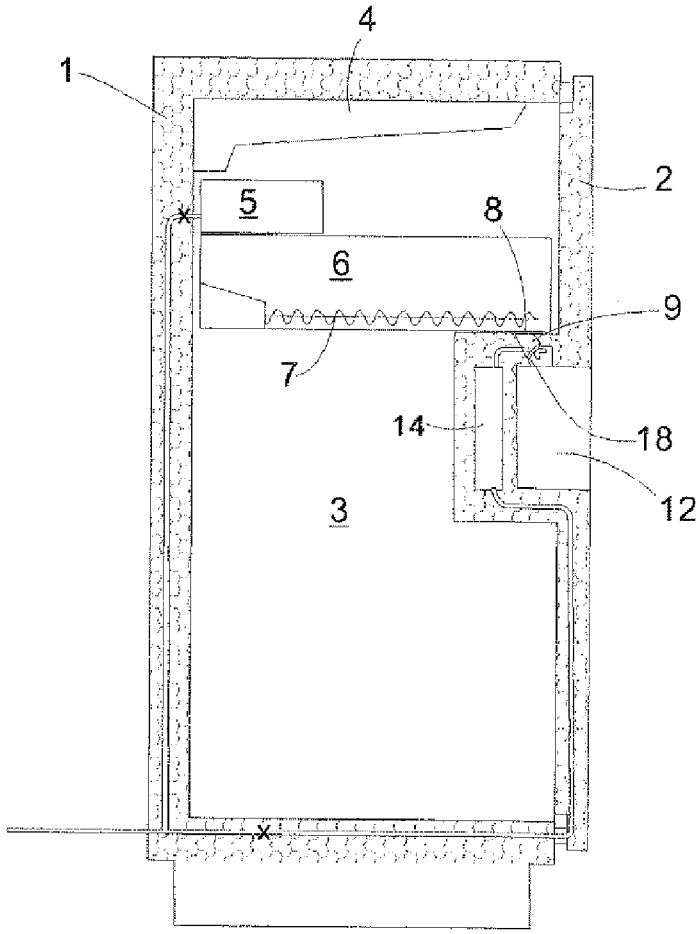
FIG. 1 shows a schematic section through a refrigeration appliance that is equipped with an inventive ice dispenser.

The refrigeration appliance shown in a schematic section in FIG. 1 has a thermally insulating carcass 1 and a door 2 which delimit an inner space serving as a freezer compartment. The inner space 3 is cooled by an evaporator which is housed in an evaporator chamber 4 divided off in the upper area of the carcass 1.

An automatic ice maker 5 is disposed immediately adjacent to the evaporator chamber 4 in the inner space 3. A collecting container 6 which catches the ice cubes produced and ejected by the ice maker 5 is located under the ice maker 5. A screw conveyor 7 at the bottom of the collecting container 6 serves to convey ice cubes to an outlet opening 8 at the end of the collecting container 6 near the door. A recess 12, an upper wall of which lies under the outlet opening 8 of the collecting container, is formed in a central area of the door 2. A tubular or funnel-shaped duct, also termed an ice chute 9, extends through this wall. A thermally insulating flap 18 is located at the lower end of the ice chute 9. In the closed position, the flap 18 hermetically closes off the ice chute 9 so that no warm air from the recess 12 can reach the inside of the refrigeration appliance through the ice chute 9.

Figure 2:
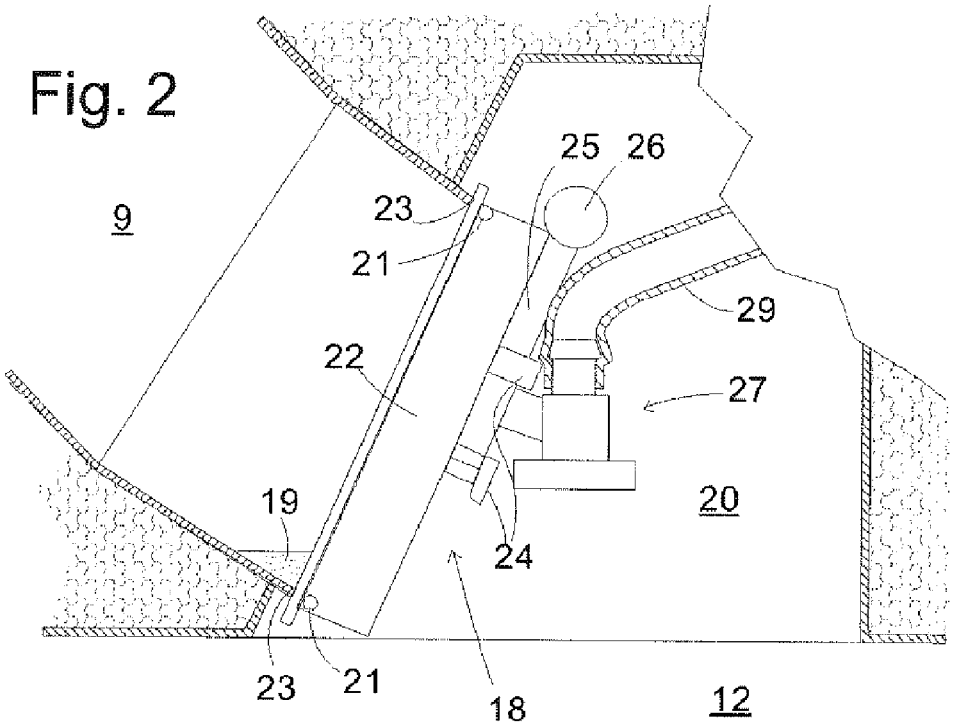
FIG. 2 shows a schematic side view of the ice dispenser with a closed flap.

FIG. 2 shows a section through the lower area of the ice chute 9 and its surroundings when the flap 18 is closed. The flap 18 is housed in a cutout 20 of the door 2, which opens downward into the recess 12. The flap 18 comprises an insulating body 22 of substantially flat cylindrical shape whose construction is explained in more detail below. In the position shown the body 22 is in close contact with an outlet opening 23 of the ice chute 9 shown in section. Circumferential heating wires 21 which prevent the body 22 of the flap freezing to the edge of the outlet opening 23 are arranged around the body 22.

The body 22 is locked in place with the aid of one-piece integrally molded hooks 24 to a plate 25 that is joined in one piece to a shaft 26 running transversely to the plane of the section. A control unit 50 (see FIG. 4) drives the shaft 26 via known means, such as a motor or electromagnets for instance, in order to open the flap intermittently. When the flap 18 is opened, the latter is rotated about the axis of the shaft 26.

Condensation water 19 that has accumulated in the lower area of the ice chute 9 cannot flow away due to the sealing effect of the flap 18 which in the closed position rests tightly against the outlet opening 23.

A cold water dispenser 27 which is permanently joined to the rear side of the plate 25 is mounted at the side of the plate 25 which faces away from the ice chute 9. The cold water dispenser 27 is connected by a flexible rubber tube 29 to a tank 14 let into the door 2. When the flap 18 is opened by the control unit, the cold water dispenser 27 is likewise rotated about the axis of the shaft 26, the rubber tube 29 being slightly deformed in the process.

Figure 3:
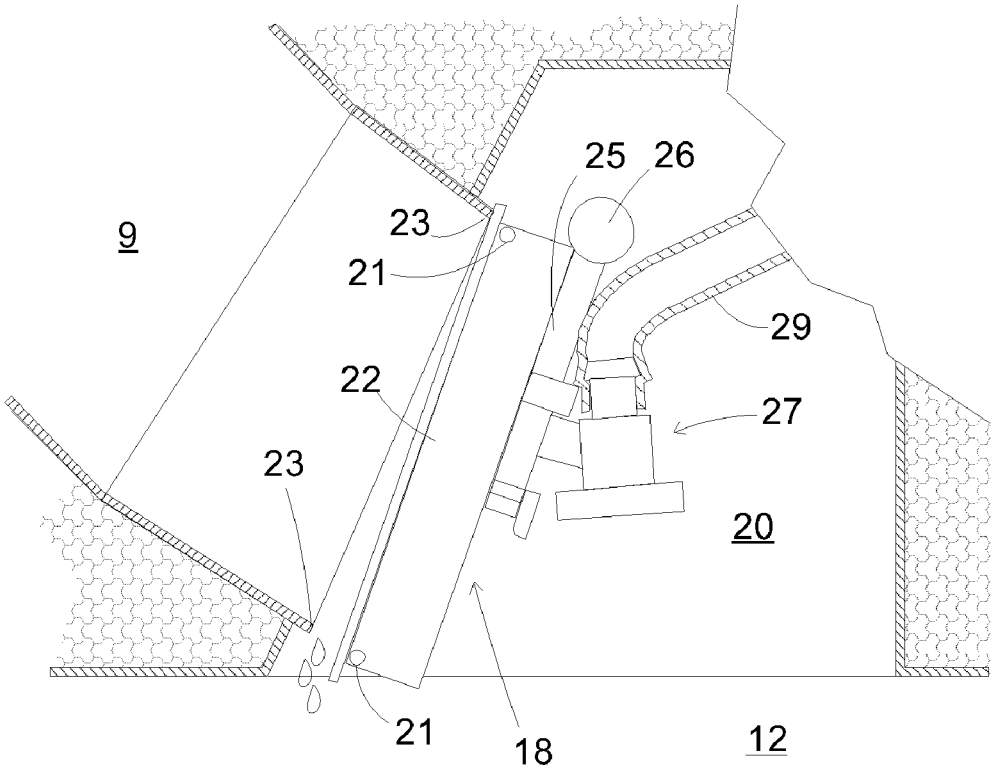
FIG. 3 shows a further schematic view of the ice dispenser with slightly open flap.

FIG. 3 shows the lower area of the ice chute 9 from FIG. 2 once again, this time with the flap 18 slightly open. The flap 18 is opened only a crack, such that the condensation water 19 drains away downward, but only a small amount of warm outside air enters the ice chute 9. It is readily apparent to a person skilled in the art that in order to dispense ice from the ice maker 5 through the outlet opening 23 the control unit 50 opens the flap 18 considerably wider than is shown in the illustration of FIG. 3, so that the position into which the control unit 50 moves the flap 18 in order to drain away the condensation water 19 lies between the closed position and an ice dispensing position.

Figure 4:
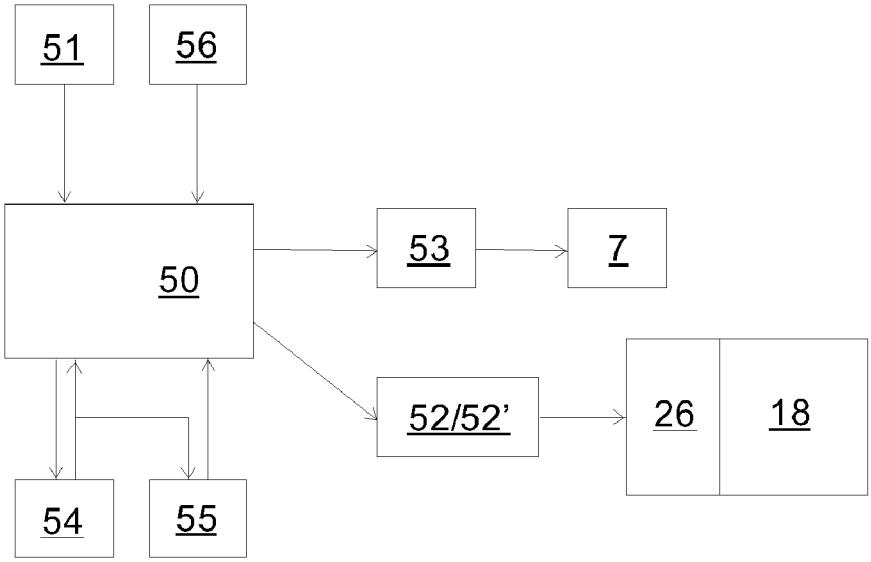
FIG. 4 shows a block diagram for illustrating the mode of operation of the ice dispenser.

The representation in FIG. 4 illustrates in a block diagram the interaction of various components of the inventive ice maker.

The control unit 50 is connected to an operator button 51 of the ice dispenser. If a user presses the button 51, the control unit 50 controls a motor 52 which drives the shaft 26 in order to open or close the flap 18 that is coupled to said shaft. The motor 52 rotates the flap to a wide open position. At the same time the control unit 50 starts up a motor 53 of the screw conveyor 7. The latter rotates for as long as the user keeps the button 51 pressed, and ice cubes are dispensed via the ice chute 9.

As soon as the user releases the button 51, the control unit 50 stops the motor 53, the motor 52 swings the flap 18 back into the closed position and a timer 54 is started. On expiration of a predetermined time period T1 of approximately 2 hours, the timer 54 sends a tripping signal to the control unit 50, causing the latter to rotate the flap 18 to the partially-open position of FIG. 3 and to start a second timer 55. After a time period T2 of approximately 5-10 seconds, this second timer in turn delivers a tripping signal to the control unit 50, causing the latter to counter-rotate the flap 18 to the closed position and to restart the timer 54. The flap 18 is therefore periodically opened at intervals of approximately 2 hours and condensation water that has accumulated in the ice chute 9 is able to drain away.

Furthermore, the control unit 50 is connected to a door switch 56 which conventionally serves to switch on the interior lighting of the refrigeration appliance when the door is opened and to switch it off again when the door is closed. The reaction of the control unit 50 to a signal of the switch 56 indicating the closing of the door is exactly the same as when the button 51 is released.

According to an alternative embodiment the motor 52 is replaced by an electromagnet 52' which acts on the flap 18 which is loaded by a spring in the closed position. The control function is simplified in this embodiment, since the control unit 50 requires no feedback signal to indicate the position of the flap 18 in order to correctly control the latter: if the electromagnet 52' is not energized the spring keeps the flap 18 closed; if the electromagnet 52' is energized by a maximum output current of the control unit 50, then the flap 18 is in the ice dispensing position and with an—e.g. pulse-width-modulated—lower strength of output current for example, the opening angle of the flap 18 lies between the closed position and the ice dispensing position.

The invention claimed is:

1. An ice dispenser for a refrigeration appliance, the ice dispenser comprising:

an ice duct which is closable by a flap; and a control unit operable to control the flap, the control unit structured to move the flap between a rest position in which the flap closes the ice duct, and a dispensing position in which the flap opens the ice duct in order to dispense ice cubes, and wherein the control unit is configured to automatically open the flap for a second time period upon expiration of a first time period during which the flap has not been moved.

2. The ice dispenser as claimed in claim 1, wherein the control unit detects a use of the ice dispenser and restarts the first time period measurement at each use.

3. The ice dispenser as claimed in claim 1, wherein the control unit is configured to detect a closing of an appliance door of the refrigeration appliance and to restart the first time period measurement each time the door is closed.

4. The ice dispenser as claimed in claim 1, wherein during the second time period, a position of the flap lies between the rest position and the dispensing position.

5. The ice dispenser as claimed in claim 1, wherein the flap is driven by an electromagnet that can be energized by at least two different permanent energizing currents.

6. The ice dispenser as claimed in claim 1, wherein the first time period is a multiple of the second time period.

7. The ice dispenser as claimed in claim 1, wherein the first time period covers a time period of at least one hour.

8. The ice dispenser as claimed in claim 1, wherein the second time period covers a time period of between about 5 and 10 seconds.

9. The ice dispenser as claimed in claim 1, wherein the flap is heated.

10. A refrigeration appliance comprising:

a thermally insulated carcass;

a freezer compartment; and an ice dispenser, the ice dispenser including:

an ice duct which is closable by a flap; and a control unit operable to control the flap, the control unit structured to move the flap between a rest position in which the flap closes the ice duct, and a dispensing position in which the flap opens the ice duct in order to dispense ice cubes, and wherein the control unit is configured to automatically open the flap for a second time period upon expiration of a first time period during which the flap has not been moved.

11. The refrigeration appliance as claimed in claim 10, wherein the control unit detects a use of the ice dispenser and restarts the first time period measurement at each use.

12. The refrigeration appliance as claimed in claim 10, wherein the control unit is configured to detect a closing of an appliance door of the refrigeration appliance and to restart the first time period measurement each time the door is closed.

13. The refrigeration appliance as claimed in claim 10, wherein during the second time period, a position of the flap lies between the rest position and the dispensing position.

14. The refrigeration appliance as claimed in claim 10, wherein the flap is driven by an electromagnet that can be energized by at least two different permanent energizing currents.

15. The refrigeration appliance as claimed in claim 10, wherein the first time period is a multiple of the second time period.

16. The refrigeration appliance as claimed in claim 10, wherein the first time period covers a time period of at least one hour.

17. The refrigeration appliance as claimed in claim 10, wherein the second time period covers a time period of between about 5 and 10 seconds.

18. The refrigeration appliance as claimed in claim 10, wherein the flap is heated.

* * * * *